US006109906A

United States Patent [19]

Castonguay et al.

[11] Patent Number: 6,109,906

[45] **Date of Patent: *Aug. 29, 2000**

[54] APPARATUS FOR TREATING CONCRETE BLOCKS

[75] Inventors: Bertin Castonguay, Sherbrooke; Eric Milot, Montreal; Jean-Pierre Perreault, St-Jean-De-Matha; Jocelyn Caux, LaPocatiere, all of Canada

[73] Assignee: Groupe Permacon Inc., Ville D'Anjou, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 08/943,409

[22] Filed: Sep. 30, 1997

[51] Int. Cl.[7] ..... B28B 11/08

[52] U.S. Cl. ..... 425/343; 264/293; 425/385

[58] Field of Search ..... 425/385, 402, 425/403.1, 472, 343; 264/293

[56] References Cited

U.S. PATENT DOCUMENTS

| | | | |
|---|---|---|---|
| 1,229,582 | 6/1917 | Butterworth . | |
| 1,454,731 | 5/1923 | Francis . | |
| 2,248,839 | 7/1941 | Wandroik et al. . | |
| 3,771,932 | 11/1973 | Van Daal | 425/296 |
| 3,834,200 | 9/1974 | Winter | 72/53 |
| 4,108,586 | 8/1978 | Gresham, Jr. | 425/385 |
| 4,147,491 | 4/1979 | Postell, Jr. | 425/385 |
| 4,495,132 | 1/1985 | Johnson | 425/385 |
| 5,084,282 | 1/1992 | Stuart et al. | 425/304 |
| 5,133,915 | 7/1992 | Metten et al. | 264/162 |
| 5,316,465 | 5/1994 | Hummel | 425/343 |

FOREIGN PATENT DOCUMENTS

| | | |
|---|---|---|
| 0 325 681 A1 | 8/1989 | European Pat. Off. . |
| 843 291 | 6/1939 | France . |
| 2320011 C2 | 11/1973 | Germany . |
| 2434368 C2 | 2/1975 | Germany . |
| 39 27 601 | 3/1991 | Germany . |
| 41 42 396 C2 | 6/1993 | Germany . |
| 195 48 932 | 7/1997 | Germany . |
| 445 218 | 4/1936 | United Kingdom . |
| 484 154 | 4/1938 | United Kingdom . |
| WO 97/24210 | 7/1997 | WIPO . |

*Primary Examiner*—James P. Mackey
*Attorney, Agent, or Firm*—Foley & Lardner

[57] ABSTRACT

An apparatus for treating selected at least partial surfaces of a masonry block, including at least a flail having a shaft with an axis of rotation in a vertical plane, at least a moving mechanism for moving one of the masonry blocks parallel to the vertical plane and the flail, mechanism for holding the masonry blocks with the selected surface to be treated at a distance from the shaft to be impacted by the flail.

20 Claims, 5 Drawing Sheets

62
56
36b
44
36a
53
44
48
30
39
54
91
50
36d
5
54
50
36b
51
49
36a
41
3
70
26
38
72

APPARATUS FOR TREATING CONCRETE BLOCKS

BACKGROUND OF THE INVENTION

1. Field of the Invention

The present invention relates to the manufacture of masonry blocks, and in particular, the treatment of finished blocks for the purpose of providing textured surfaces to such blocks.

2. Description of the Prior Art

Landscape retaining walls are generally made of concrete blocks having top and bottom surfaces which are generally hidden from view when the blocks are installed. The front face of such blocks is exposed, but the rear surface is not. The side surfaces, at least near the corners with the front face, are sometimes exposed in an assembled retaining wall. In order to provide the blocks with a natural stone look, it is preferred to give at least the front face a textured finish. A typical method of creating a textured finish is to mold the blocks in a slab and to split the slab, utilizing the fractured surfaces as the exposed front face. It is difficult to control the resulting surface since the slab could split along a fissure at an angle or actually produce a smooth portion.

It is also known to tumble the concrete blocks in a tumbler to chip the surfaces. However, all the surfaces are thus being treated rather than just the front or side surfaces. Furthermore, there is no control over the actual texture of the surface.

Furthermore, the process of manufacturing the blocks, including a surface treatment step, requires additional handling of the blocks after they have been molded. For instance, once the blocks have been produced and stacked, they must then be introduced into a tumbler or other apparatus to provide a surface treatment and then stacked again.

SUMMARY OF THE INVENTION

In the present disclosure masonry block means any masonry stone, concrete blocks or artificial paving stone used for masonry paving, garden retaining walls, curb blocks, and other similar products used with or without mortar.

It is an aim of the present invention to provide a method and apparatus for selectively treating surfaces of masonry blocks.

It is a further aim of the present invention to provide an apparatus for treating selected surfaces of a masonry block whereby the means for treating the surfaces may be adjusted to produce controlled and various surface textures.

It is a further aim of the present invention to provide a process of manufacturing concrete blocks, wherein the concrete block is formed and selected surfaces are treated in a continuous manner.

It is a further aim of the present invention to provide a manufacturing which is significantly faster than conventional methods.

A construction in accordance with the present invention comprises an apparatus for treating selected surfaces of a masonry block, including at least a flail means having a shaft with an axis of rotation in a vertical plane, at least a moving means for moving one of the masonry block and the flail means relative to one another with the masonry block in a plane parallel to the vertical plane, means for holding the masonry blocks with the selected surface to be treated at a distance from the shaft of the flail to be impacted by the flail means.

A method of treating a selected surface of a masonry block, in accordance with the present invention, comprises the steps of advancing a masonry block past a flail station, wherein the flail rotates about an axis in a vertical plane, selecting at least a partial surface to be treated by the flail and orienting the block on the conveyor to expose the selected at least partial surface to the flail, and holding the block in position on the conveyor so that, as the block passes by the flail, the flail will impact on the selected surface.

An advantage of the present invention is to permit only one surface or part of a selected surface to be treated. It also permits the treatment of blocks having different dimensions such as height to be treated.

Another aspect of the present invention comprises a method of manufacturing a concrete block for a retaining wall, wherein at least one surface of the concrete block is treated, including the steps of molding a concrete block with concrete material, advancing the block to a curing station, advancing the cured block while selecting a surface of the block to be treated, separating and advancing the blocks on a conveyor past a flail rotating in a vertical plane so that the surfaces of the blocks to be treated are exposed to the flail as the concrete blocks advance on the conveyor parallel to the vertical plane.

This is a one step on-line process which allows the concrete blocks to be molded and treated.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
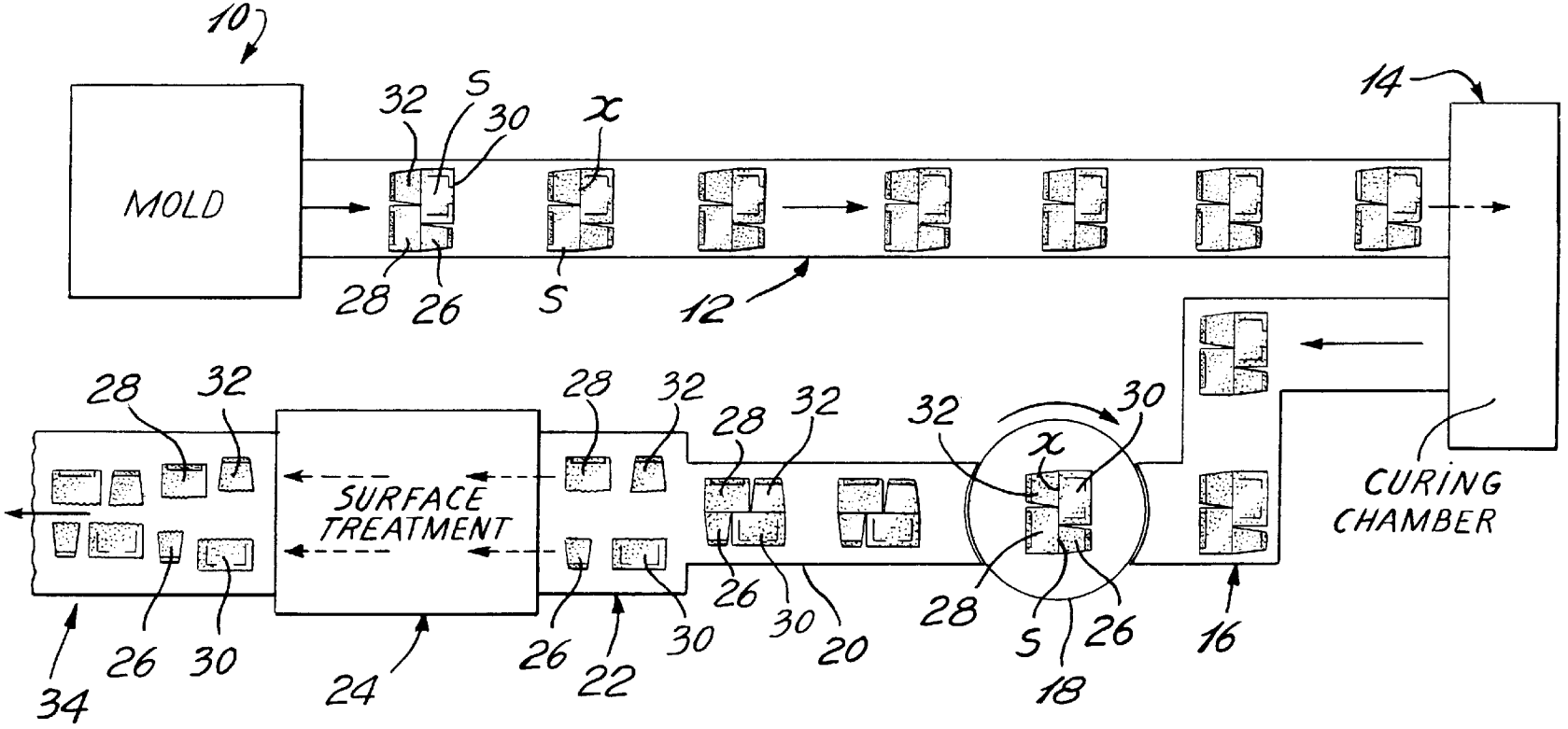
FIG. 1 is a schematic view of a manufacturing process for manufacturing concrete blocks.

Referring now to FIG. 1, a continuous process of manufacturing retaining wall concrete blocks is illustrated. As shown schematically in FIG. 1, a mold station 10 is provided for molding slabs of concrete blocks. The slab S advances on a conveyor 12 after it has been demolded and passes to a curing chamber 14. As seen, each slab contains concrete blocks 26, 28, 30, 32, formed of different sizes and shapes. In this embodiment, each slab S has a fractionating line X which bisects the slab S defining the front surfaces of the concrete blocks.

The slabs S are stacked on racks in the curing chamber for approximately 24 hours and are then advanced on a conveyor 16 towards a splitter station and rotating table 18. The slab S is split along fractionating line X and is rotated so that the separated blocks 26, 28, 30, and 32 are aligned with the surface treatment station 24, that is, with the surfaces to be treated facing each other. The blocks advance to a separating station 22 where the pairs of blocks are spread apart and aligned with the conveyors 38 and 40 which will be described later. Once the blocks have been surface treated in station 24, they can be advanced on an exit conveyor 34 towards a packaging station.

As can be seen from this method, the concrete blocks are molded and surface treated in one continuous process.

Referring to FIGS. 2 through 5, the surface treatment station 24 will now be described.

Figure 3:
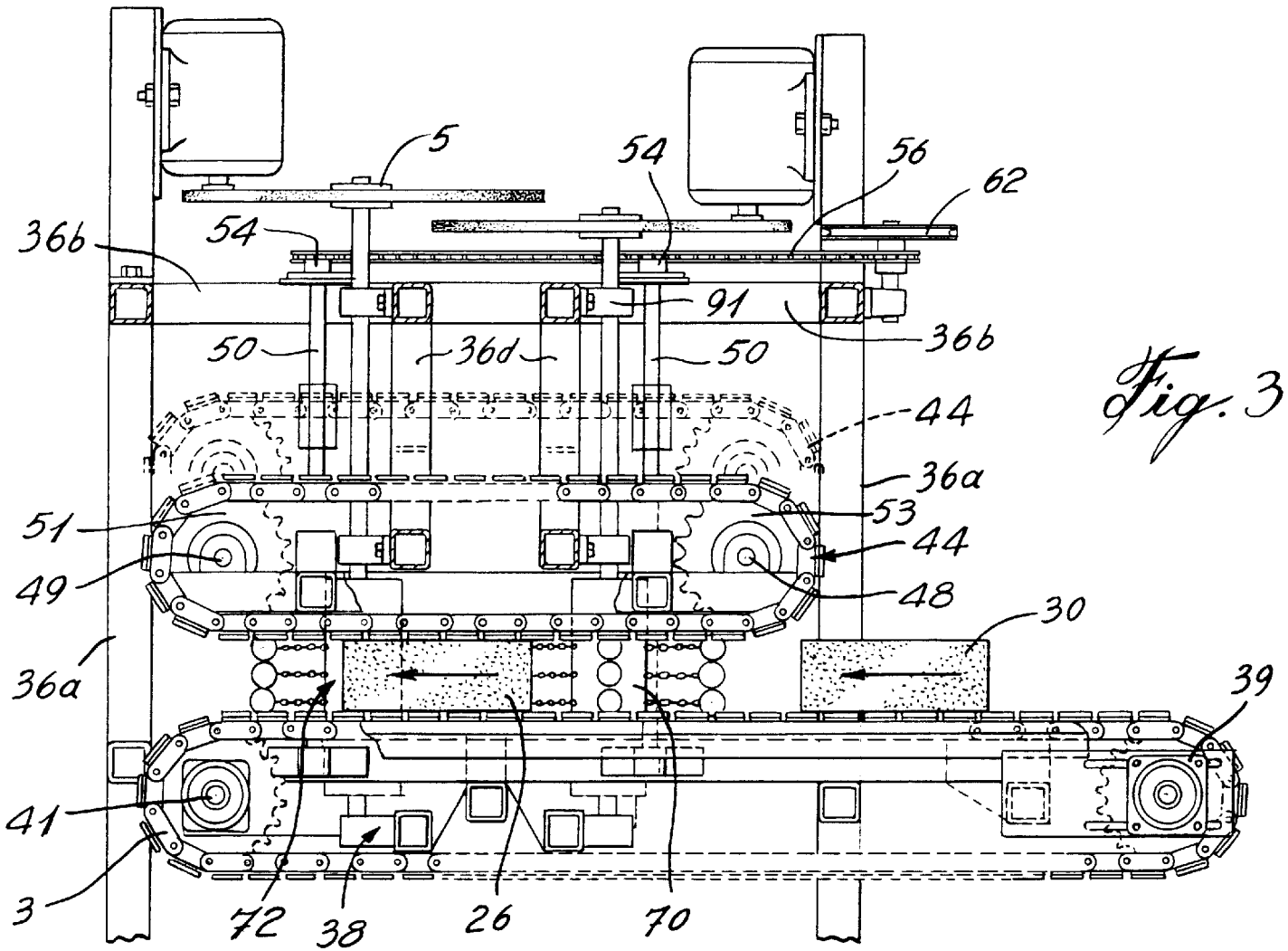
FIG. 3 is a vertical cross-section, taken along line 3—3 of FIG. 2.

The station 24 includes a frame 36 made up of columns 36*a* and upper beams 36*b* and lower beams 36*c*. A pair of lower conveyors 38 and 40 are mounted on the lower frame beams 36*c*. As seen in FIG. 3, the conveyors 38 and 40 typically include an endless belt mounted on sprockets 39 and 41, which sprockets are driven by a motor (not shown).

A pair of upper conveyors 44 and 46 are located directly above the conveyors 38 and 40 and are spring mounted on a movable frame 42. The movable frame 42 includes beams 42*b* and lower beam brackets 42*a*.

Figure 2:
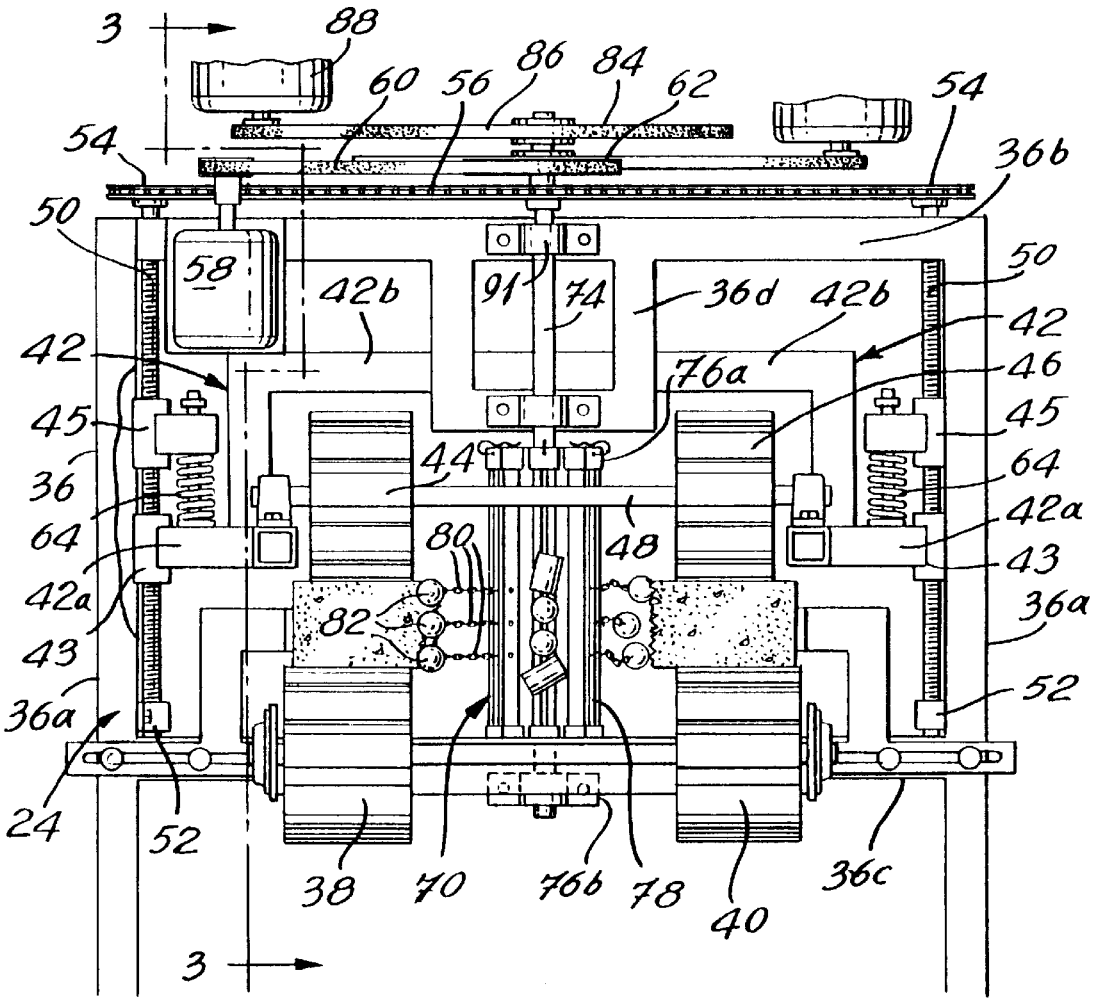
FIG. 2 is an end elevation of a surface treating machine in accordance with the present invention.
Figure 4:
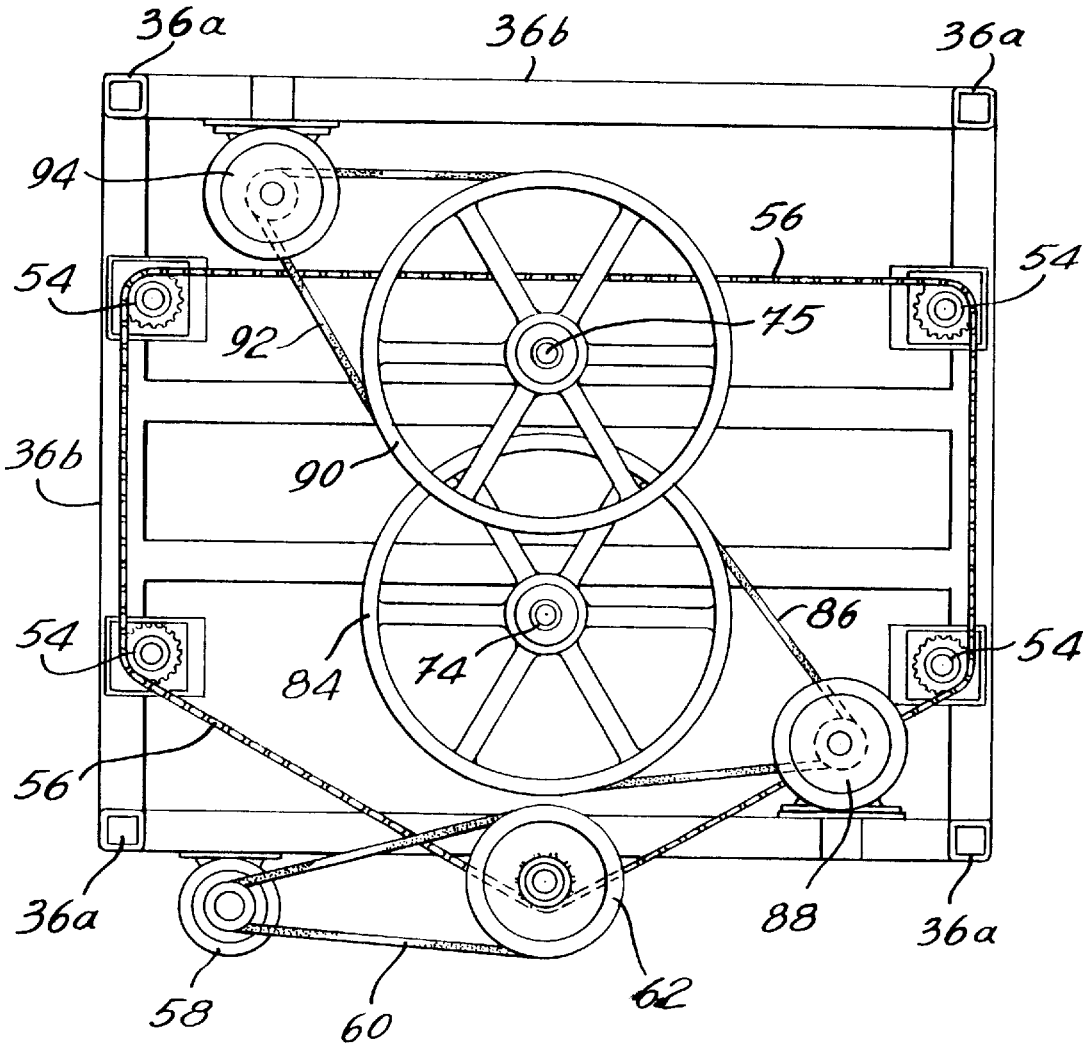
FIG. 4 is a top plan view of the apparatus shown in FIGS. 2 and 3.

The whole of the frame 42 moves on rotating screws 50 which are set in journals 52. The four screws 50 include sprockets 54 at their upper ends which are, in turn, entrained by a chain 56 driven by sprocket 62 which is connected by a belt 60 to motor 58, as seen in FIG. 4. The upper frame 42 includes sleeves 43 which merely slide on the screws and are not engaged by the threads of the screws. Sleeves 45, however, are threaded and are engaged by the screws 50 in order to move the upper frame 42 vertically. The lower frame brackets 42*a* are connected to the sleeves 45 by means of springs 64, as shown in FIG. 2. The conveyors 44 and 46 are mounted by means of shaft 48 onto the lower frame brackets 42*a* and are thus loaded downwardly by means of gravity and the springs 64. The upper conveyors 44 and 46 can thus be moved upwardly or downwardly, depending on the size of the blocks to be treated. It is important that conveyors 44, 46, as will be described later, apply pressure to the top and bottom surfaces of the blocks passing on conveyors 38 and 40 in order to retain the blocks and prevent them from moving laterally when they are being treated, as will be described.

The upper conveyors 44, 46 may be the conveyors which are kept rigid once place and the lower conveyors 38, 40 may be loaded. For instance the conveyors 38 and 40 may be mounted on resilient supports or the conveyor pads may be supported on neoprene supports.

Figure 5:
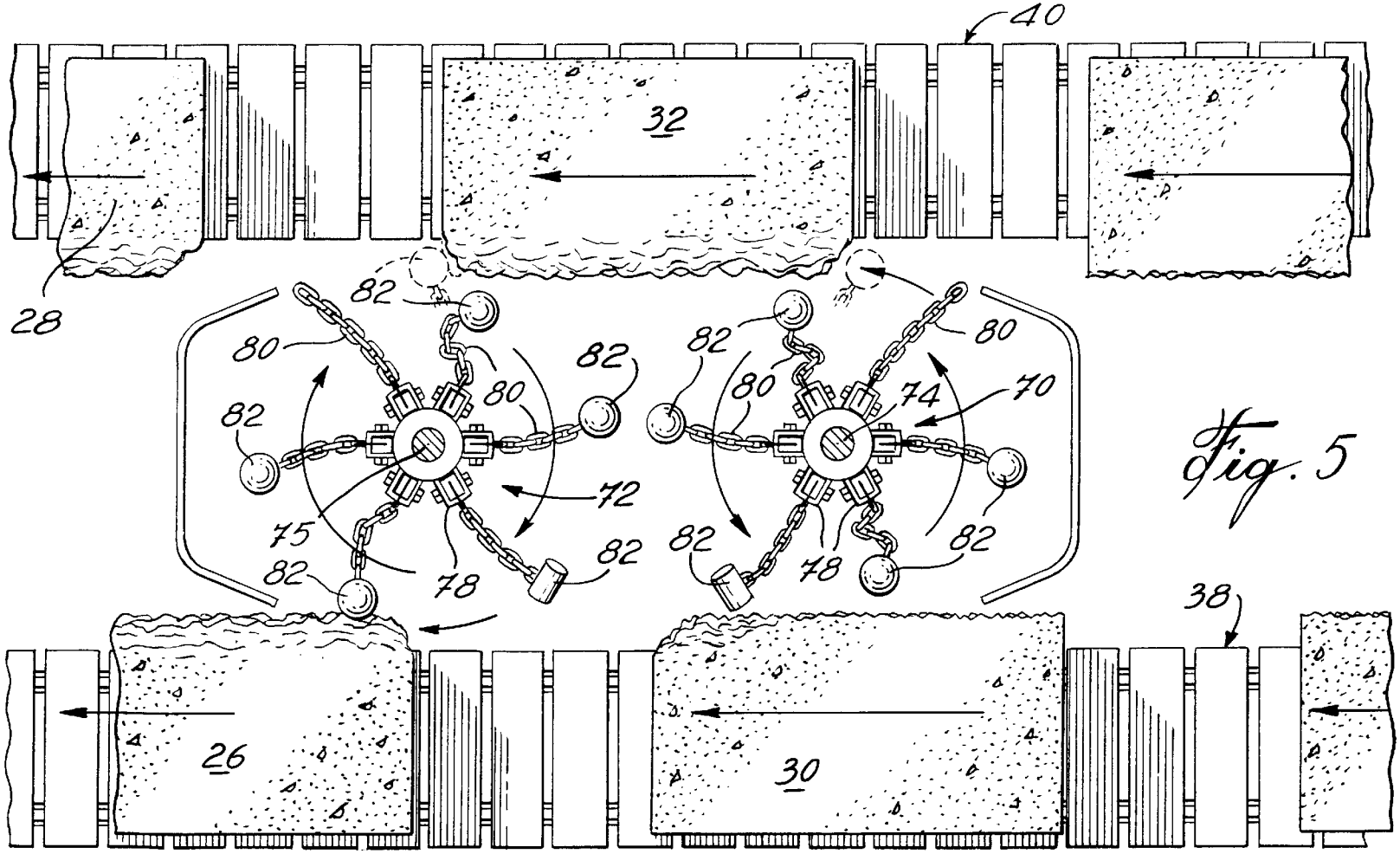
FIG. 5 is an enlarged horizontal plan view which has been simplified, showing the operative elements of the embodiment of FIGS. 2, 3, and 4.

The main treatment elements are flails 70 and 72 which, in this case, rotate in opposite directions in order to provide a balanced distribution of impacts, particularly at the corners of the blocks. Flails 70 and 72, as best shown in FIGS. 2 and 5, include rotating shafts 74 and 75 which extend in vertical axes in a vertical plane and are rotated by means of pulleys 84 and 90 respectively which are, in turn, independently driven by motor 88, belt 86, and motor 94 and belt 92 respectively. The pulleys may be replaced by direct drive motors. Thus, the flails 70, 72 can be rotated at different speeds, if necessary.

The flails must be preferably dynamically balanced.

Each flail 70 and 72 includes brackets 76*a* and 76*b* which hold individual track segment 78 in which the chains 80 may be anchored. Each chain may carry a head 82 such as a steel cast ball or cylindrical blocks, as shown in FIG. 5. The chain 80 may be selected without a head 82 depending on the type of texture that is required on the surface of the concrete block. A minimal amount of experimentation is required to arrive at a proper match of flail speed, selection of flail heads, and the position of the flails in the vertical axis along the tracks 78.

Each of the flails can be designed for the treatment effect required on the surface of the block. Typically, blocks 26 and 30 pass on conveyor 38, as shown in FIG. 5, and blocks 28 and 32 from the same slab S pass on the conveyor 40. They are aligned on the conveyors 38 and 40 so that the surfaces to be treated project slightly inwardly of the conveyors 38 and 40 and are held in this position as they travel past the flails 70, 72 by means of the upper conveyors 44 and 46, as shown in FIGS. 2 and 3. The upper conveyors 44 and 46 are mounted on driven shafts 48 and 49, which must be synchronized with the lower conveyors 38 and 40, and each include an endless belt traveling about sprockets 51 and 53.

It is also noted that the flails 70, 72 are effective for treating around the corners of the front surfaces of the blocks to provide the blocks with a natural stone look.

It is evident that the blocks can be rotated in any orientation in order to selectively treat a given surface. Only one flail 70 need be utilized. It is also contemplated that a single pair of lower and upper conveyors may be used.

Thus, the texture which is selected for the surface may be varied by adjusting the speed of rotation of the flails 70, 72 on the conveyors. Also the heads 82 on the ends of the chains as well as the number and position of the flail chains that might be provided in a vertical arrangement may be varied.

We claim:

1. An apparatus for treating a partial surface of a masonry block, comprising:

a flail having a shaft with an axis of rotation in a vertical plane;

moving means for moving the masonry block past the flail; and means for holding the masonry block with the partial surface to be treated at a distance from the shaft to be impacted by the flail.

2. An apparatus for treating a selected surface of a masonry block, comprising:

a flail having a shaft with an axis of rotation in a vertical plane;

a conveyor, wherein the conveyor transports said masonry block past the flail; and means for clamping the masonry block to the conveyor with the selected surface to be treated at a distance from the shaft to be impacted by the flail as the masonry block advances with the conveyor past the flail.

3. An apparatus as defined in claim 2, wherein the flail includes a driven shaft extending in an axis in the vertical plane, and the flail further includes a chain attached at one end to the shaft and impact means on the other end of the chain for contacting and chipping the selected surface of the masonry block moving on the conveyor.

4. An apparatus as defined in claim 3, wherein the impact means is a chain link at said other end of the chain.

5. An apparatus as defined in claim 3, wherein the impact means is an impact head at said other end of the chain.

6. An apparatus as defined in claim 3 wherein there are a plurality of chains mounted to the shaft at different positions on the shaft for contacting different areas of the selected surface.

7. An apparatus as defined in claim 2, wherein a pair of parallel conveyors are provided one on either side of the vertical plane, wherein means for clamping a masonry block is associated with each of the conveyors so as to advance a masonry block on either side of the vertical plane past the flail.

8. An apparatus as defined in claim 2, wherein there are at least two flails in the vertical plane, both having shafts extending along axes in the vertical plane and spaced apart from each other.

9. An apparatus as defined in claim 8, wherein the at least two flails are driven in opposite rotating directions.

10. An apparatus as defined in claim 1, wherein the axis of rotation is a vertical axis in a vertical plane.

11. An apparatus as defined in claim 7, wherein a lower driven conveyor for advancing a masonry block and an upper driven conveyor synchronized with the lower driven conveyor are provided on each side of the vertical plane, the upper conveyor is adjustable in a vertical axis and is adapted to contact the masonry block on the lower conveyor and resilient means are provided for pressing at least one of the upper and lower conveyors against the masonry block.

12. An apparatus as defined in claim 11, wherein there is provided a pair of parallel lower conveyors, one on each side of the vertical plane, and a pair of upper conveyors spaced above the lower conveyors and aligned therewith and the conveyors are resiliently mounted on a frame and adjustable in the vertical axis for clamping on the masonry blocks passing on either side of the flail on the lower conveyors.

13. An apparatus as defined in claim 3, wherein the flail includes removable vertical tracks mounted to the shaft and in each track a number of chains can be arranged in a vertical arrangement.

14. An apparatus for treating a surface of a masonry block, comprising:

a flail having a shaft with an axis of rotation;

a conveyor, wherein the conveyor allows the moving of the masonry block past the flail; and a guide, wherein the guide aids in holding the masonry block with the surface to be treated at a distance from the shaft to be impacted by the flail.

15. An apparatus as defined in claim 14, wherein the conveyor comprises a first moving belt and the guide comprises a second moving belt.

16. An apparatus as defined in claim 14, wherein the axis of rotation of the flail is vertical.

17. An apparatus as defined in claim 1, wherein the axis of rotation is essentially vertical within the vertical plane.

18. An apparatus as defined in claim 2, wherein the axis of rotation is essentially vertical within the vertical plane.

19. An apparatus as defined in claim 7, wherein the axis of rotation is essentially vertical within the vertical plane.

20. An apparatus as defined in claim 7, further comprising a second flail having a shaft with an axis of rotation in a vertical plane.

* * * * *